US006175998B1

(12) United States Patent
Leo

(10) Patent No.: US 6,175,998 B1
(45) **Date of Patent: *Jan. 23, 2001**

(54) HAND TOOL FOR GRIPPING AND JOINING DUCT SECTIONS

(76) Inventor: Mark D. Leo, 545 Ridge Cir., Streamwood, IL (US) 60107

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/095,273

(22) Filed: Jun. 10, 1998

(51) Int. Cl.[7] ..... B25B 1/24
(52) U.S. Cl. ..... 29/268; 81/420
(58) Field of Search ..... 29/268, 243.56, 29/238; 81/418, 420, 421, 424.5, 426, 426.5

(56) References Cited

U.S. PATENT DOCUMENTS

| | | | | |
|---|---|---|---|---|
| 1,102,384 | * | 7/1914 | Bernard | 81/418 |
| 1,484,100 | * | 2/1924 | Wertz | 81/419 |
| 2,277,081 | * | 3/1942 | Lillo . | |
| 2,641,149 | * | 6/1953 | Petersen | 81/424.5 |
| 3,169,034 | * | 2/1965 | Epstein | 81/419 |
| 3,181,340 | * | 5/1965 | Gruetzmacher | 81/426 |
| 3,202,023 | * | 8/1965 | Parker . | |
| 3,314,319 | * | 4/1967 | Schmidt | 81/420 |
| 3,329,001 | * | 7/1967 | Ringzelli et al. | 81/425.5 |
| 3,602,971 | * | 9/1971 | Halstead | 81/419 |
| 3,745,638 | * | 7/1973 | Minera . | |
| 3,964,148 | * | 6/1976 | Sturtevant | 81/418 |
| 4,386,542 | * | 6/1983 | Verna . | |
| 4,386,543 | | 6/1983 | Walker | 29/268 |
| 4,475,726 | * | 10/1984 | Smith . | |
| 4,713,959 | | 12/1987 | Bennett | 29/243.56 |
| 4,724,729 | * | 2/1988 | Oetiker | 81/418 |
| 4,769,891 | * | 9/1988 | Corral . | |
| 4,989,479 | * | 2/1991 | Anderson et al. | 81/418 |
| 5,168,783 | * | 12/1992 | Shea | 81/418 |
| 5,594,982 | * | 1/1997 | Dobbeck . | |
| 5,661,886 | * | 9/1997 | Smith . | |
| 5,865,072 | * | 2/1999 | Jerdee | 81/424.5 |

* cited by examiner

*Primary Examiner*—Robert C. Watson
(74) *Attorney, Agent, or Firm*—Olson & Hierl, Ltd.

(57) ABSTRACT

A hand tool for gripping and joining together adjacent duct sections. The hand tool includes jaws which are adapted to be wedged between the wall and the drive edge of the adjacent duct sections respectively where the hand tool is used in a first orientation where the hand tool is positioned generally perpendicularly to the walls of the duct sections. A notch in each of the jaws defines a time which is adapted to be wedged between the wall and the drive edge of the adjacent duct sections respectively where the tool is used in a second orientation where the tool is positioned generally parallel to the wall of the duct sections. The handle on the tool is closed to bring the jaws together and thus the duct sections gripped thereby together into abutting relationship so as to allow a drive cleat to be applied to the drive edges of the duct sections to secure the duct sections together. A locking assembly associated with the handle allows the tool to be clamped to the duct sections.

9 Claims, 6 Drawing Sheets

56
20
37
55
54
24
36
34
52
35
48
58
70
28
46
32
62
50
30
43
66
60
64
26
40
44
22
42
68
47
29

35
28
24
20
70
32
34
37
55
56
54
36
30
62
48
64
68
46
43
58
40
66
42
44
47
29
26
22
60

HAND TOOL FOR GRIPPING AND JOINING DUCT SECTIONS

FIELD OF THE INVENTION

This invention relates to a hand tool and, more particularly, to a hand tool for gripping and joining duct sections.

BACKGROUND OF THE INVENTION

The installation of heating and air conditioning systems requires the installation of an extensive network of ducting which consists of a plurality of separate box-like duct sections which have been joined together along their respective peripheral edges into an adjoining and abutting relationship. The duct sections include respective peripheral adjoining and abutting drive edges adapted to receive drive cleats which securely clamp the respective adjoining duct sections together.

The procedure for gripping and joining adjacent duct sections together presently includes the use of a conventional screwdriver or the like prying device for initially prying the drive edges on the duct sections away from the outer surface of the duct section. The procedure also involves the use of a conventional pliers or the like hand tool for gripping the drive edges of the respective adjoining duct sections and subsequently joining the adjacent duct sections together into abutting relationship so as to allow the securement of the drive cleat thereto.

A problem associated with the use of a conventional pliers is that the jaws are not particularly structured to effectively and securely grip the respective duct drive edges. Another disadvantage is that a conventional pliers or the like tool cannot be clamped onto the drive edges and, as a result, one hand must remain on the tool at all times during the procedure. Because the procedure also requires holding up the bottom of the duct section which is being secured and further securing the drive cleat to adjoining duct sections, the assistance of a second person or the use of a third tool such as a lift or a ladder is required to hold the bottom of the duct section in place while the drive cleat is being applied and secured thereto.

U.S. Pat. No. 3,314,319 to Schmidt discloses a hand tool including jaws adapted to grasp the drive edges of adjacent duct sections and a toggle vice-grip type handle which allows the hand tool to be clamped to the duct sections after the duct sections have been joined together by the tool into adjacent and abutting engagement. The clamping feature allows the user to remove his/her hand from the tool to retrieve and secure a drive cleat onto the abutting drive edges of the respective adjoining duct sections.

A disadvantage associated with the Schmidt tool however is that it is usable only where the tool is disposed in an orientation generally perpendicular to the duct sections. This disadvantage is particularly significant where necessity requires, as it does in most situations, the installation of duct sections in close proximity to a wall or the like and there is insufficient room between the wall and the duct sections to orient the tool perpendicularly to the duct section.

Another disadvantage associated with the Schmidt tool is the forked jaw structure thereof allows the drive edges of the respective duct sections to be gripped only if the drive edges have previously been separated from the outer surface of the duct sections. However, since duct sections are fabricated in a manner in which the drive edges are smashed closed against the outer surface thereof, the drive edges must be pried away from the surface of the duct sections with another tool before the Schmidt tool can be used.

The hand tool of the present invention avoids the disadvantages associated with prior tools by providing a hand tool which is adapted to easily and efficiently open up the drive edges and subsequently grip and join together adjoining duct sections and which is useable in two different orientations, i.e., an orientation where the tool is positioned generally perpendicular to the duct sections and an orientation where, because of limited clearance space, the tool is positioned generally parallel to the duct sections.

SUMMARY OF THE INVENTION

The present invention is a hand tool for use in gripping and joining together adjacent duct sections each including an outer surface and a peripheral drive edge. The hand tool comprises first and second handles and first and second jaws associated with the first and second handles respectively. The jaws are movable and positionable towards and away from each other in response to the movement of one or both of the first and second handles. Each of the first and second jaws includes a distal outwardly converging top surface. In another embodiment of the invention, each of the first and second jaws also includes a distal outwardly converging bottom surface which, in combination with the outwardly converging top surface, defines a tip.

According to the invention, the hand tool is operable in a orientation where the hand tool is disposed generally perpendicularly to the adjacent duct sections and the first and second jaws are brought into gripping engagement with the respective duct sections such that the top surface of the tip of the respective first and second jaws contiguously engages the outer surface of the respective duct sections and the bottom surface of the respective first and second jaws engages the drive edge of the respective duct sections to facilitate the wedging of the tip of the respective jaws between the outer surface and the drive edge of the respective duct sections.

Each of the first and second jaws further includes a notch in the tip which defines a tine. The tine allows the hand tool to be used in a second orientation where the hand tool is positioned generally parallel to the duct sections and the tine on the first and second jaws respectively is adapted to be wedged between the outer surface and the drive edge of the respective duct sections when the first and second jaws are brought into gripping engagement with the drive edge of the respective duct sections.

In both orientations, the duct sections are joined together into abutting relationship by bringing the jaws of the hand tool together after the jaws have gripped the drive edges of the duct sections respectively.

A lock assembly associated with the first and second handles allows the first and second jaws and the hand tool to be releasable clamped to the abutting duct sections after they have been joined together. The lock assembly allows a user to release his/her hand from the tool to retrieve and apply a drive cleat to the adjoining duct sections thereby securing the abutting duct sections together.

There are other advantages and features of the hand tool of the present invention which will become more readily apparent from the following detailed description of the preferred embodiment of the invention, the accompanying drawings and the appended claims.

DESCRIPTION OF THE PREFERRED EMBODIMENT

Figure 1:
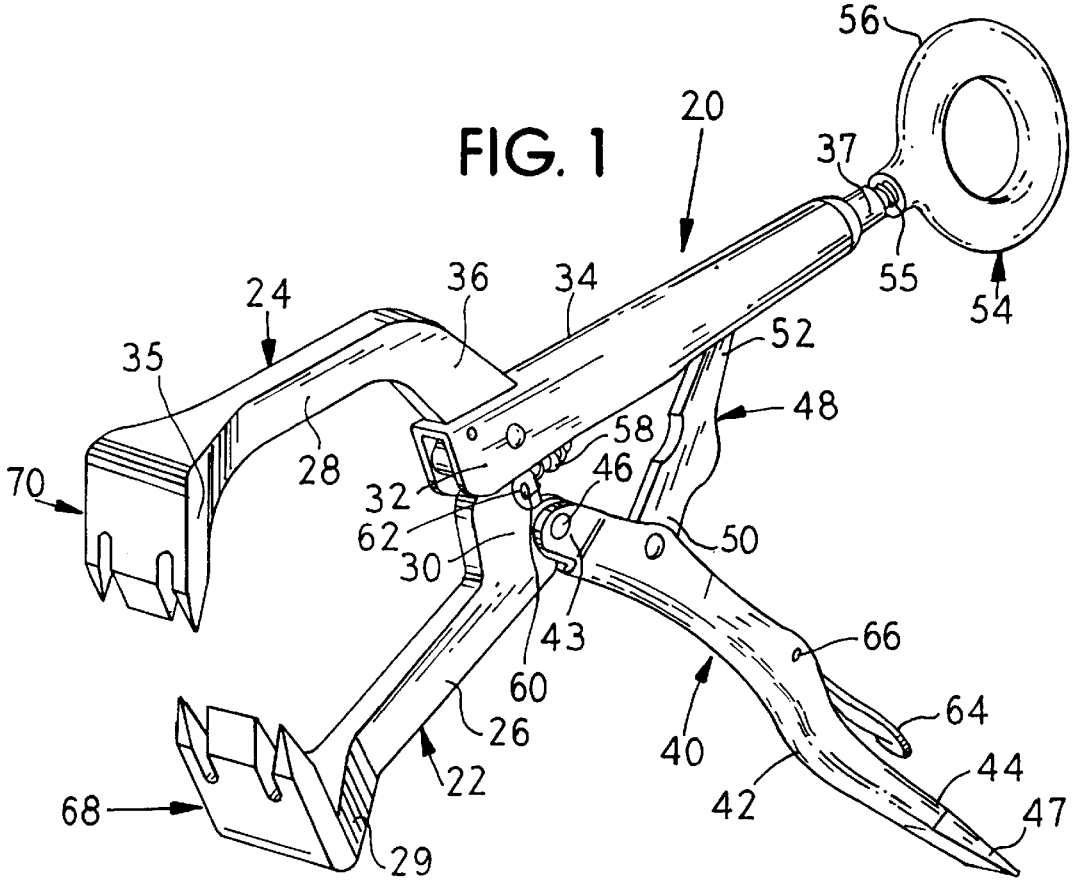
FIG. 1 is a perspective view of a hand tool in accordance with the present invention.

The hand tool disclosed herein is, of course, susceptible of embodiment in many different forms. Shown in the drawings and described below in detail is a preferred embodiment of the hand tool of the present invention. It is to be understood, however, that the present disclosure is an exemplification of the principles of the invention and does not limit the invention to the illustrated embodiment.

Figure 2:
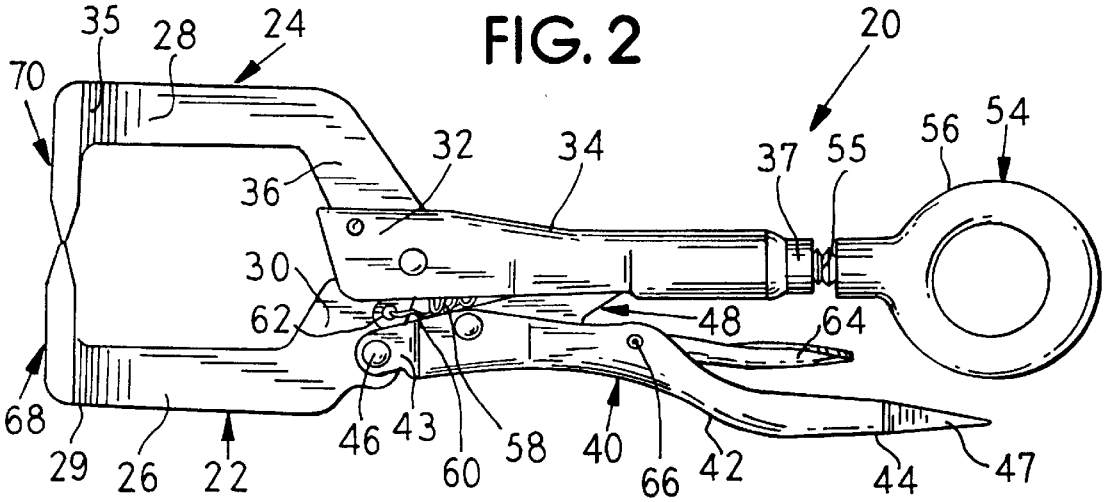
FIG. 2 is a side elevational view of the hand tool of FIG. 1.

A hand tool 20 in accordance with the present invention is depicted in FIGS. 1 and 2 and includes a pair of opposed symmetrical and generally U-shaped gripping members 22 and 24 which are essentially mirror images of each other. The members 22 and 24 include arms 26 and 28 respectively. Arm 26 includes a distal end 29 and an opposite inwardly curved proximal end 30 which extends into the interior of the distal end 32 of a handle 34 and is pivotally secured therein by means of a rivet 38 or the like. Arm 28 includes a distal end 35 and an opposite inwardly curved proximal end 36 which is also connected to the proximal end 32 of the handle 34.

The hand tool 20 further includes a toggle or vice-grip type clamping handle assembly 40 which is well known in the art and which is simply exemplary of the many forms of currently available toggle or handle assemblies which could be substituted for the toggle assembly 40 without departing from the scope of the present invention. It is also understood that the hand tool 20 could likewise include conventional pliers like handles instead of a clamping toggle assembly.

Briefly, the toggle assembly 40 includes a toggle handle 42 including a distal end 44 and a proximal end 43 pivotally connected to the curved proximal end 30 of the arm 26 by means of a rivet 46 or the like. The distal end 44 terminates in a pointed wedge or tip 47.

The toggle assembly 40 further includes a toggle link 48 operatively associated with the handles 34 and 42 respectively and particularly including one end 50 pivotally connected to the toggle handle 42 adjacent the proximal end 43 thereof as by a rivet or the like and an opposite end 52 which extends into the interior of the handle 34 and is seated on the top (not shown) of a fulcrum member 54 including a shaft 55 which is threaded into the interior of the distal end 37 of the handle 34 and a donut-shaped handle 56 which is operatively associated and threaded onto the distal end of the shaft 55.

The toggle assembly 40 further includes a spring 58 having a hooked end 60 connected to an aperture 62 in the proximal end 30 of the arm 26 and an opposite hooked end (not shown) connected to a hook (not shown) located in the interior of the handle 34.

An operating lever 64 is pivotally connected, as by a rivet 66 or the like, adjacent to the distal end 44 of the handle 42.

Figure 3:
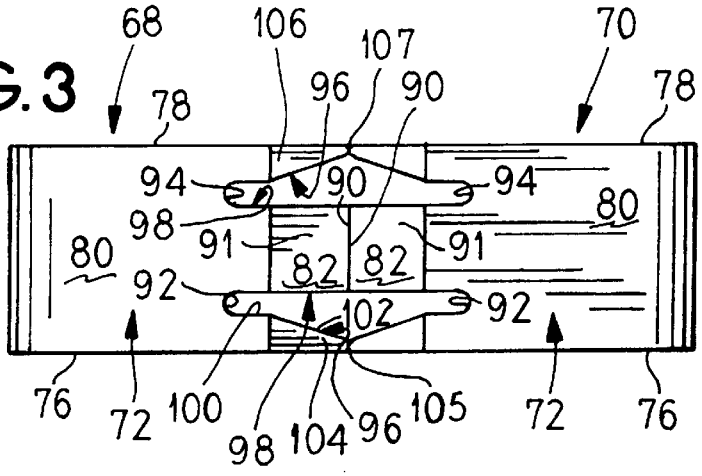
FIG. 3 is an enlarged plan view of the jaws of the hand tool of FIG. 1.
Figure 4:
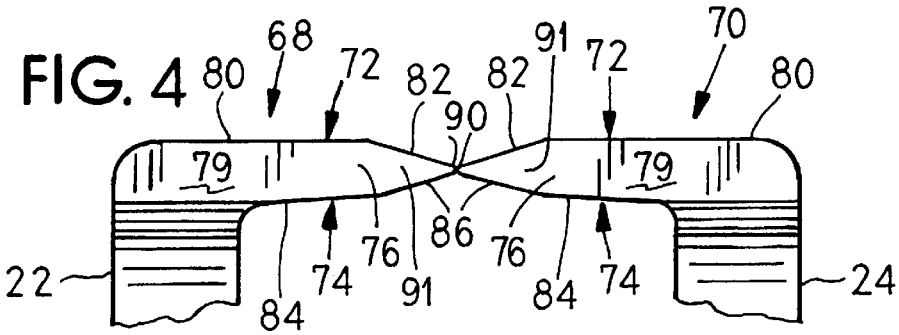
FIG. 4 is an enlarged broken side elevational view of the jaws of the hand tool of FIG. 1.

As shown in FIGS. 1 and 2, and in more detail in FIGS. 3 and 4, the gripping members 22 and 24 include jaws 68 and 70 respectively which extend unitarily inwardly from the distal ends 29 and 35 respectively of the arms 26 and 28 respectively.

In the preferred embodiment of the present invention, the jaws 68 and 70 are essentially mirror images of each other and are disposed in a co-planar relationship with respect to each other when they are closed and in a generally transverse relationship with respect to the arms 26 and 28 respectively.

Each of the jaws 68 and 70 includes spaced apart top and bottom generally flat surfaces 72 and 74 respectively and spaced apart and parallel side generally flat surfaces 76 and 78 respectively defining a generally rectangularly shaped body 79. The top surface 72 includes a straight back portion 80 which extends unitarily transversely outwardly from the inner surface of the distal end of the gripping members 22 and 24 respectively and an inclined or sloped distal end portion 82 which converges unitarily outwardly from the back portion 80. The bottom surface 74 includes a straight back portion 84 which extends unitarily outwardly from the inner surface of the distal end of the respective gripping members 22 and 24 and an inclined or sloped distal end portion 86 which converges unitarily outwardly from the back portion 84.

The back portions 80 and 84 are respectively spaced from and parallel to each other while the sloped portions 82 and 86 are positioned generally opposite each other in a symmetrical relationship. The distal end portions 82 and 86 of the top and bottom surfaces 72 and 74 respectively converge inwardly towards each other from their respective unitary straight portions 80 and 84 and terminate into a longitudinally extending peripheral point or edge 90. The distal inwardly converging end portions 82 and 86 respectively in combination with the edge 90 define a pointed tip or wedge 91 on each of the jaws 68 and 70.

Although FIG. 4 shows the end portions 82 and 86 converging inwardly at about a 15° angle relative to their respective back portions 80 and 84, it is understood that the angle of inclination of either or both of the end portions can be varied as desired without departing from the scope of the invention. It is also understood that the invention encompasses other embodiments where either or both of the end portions 82 and 86 are straight rather than sloped.

Each of the jaws 68 and 70 further includes a pair of spaced apart and generally parallel elongate notches 92 and 94. Notch 92 is positioned adjacent to and generally parallel to the side surface 76 of the jaws 68 and 70 respectively. Notch 94 is positioned adjacent to and generally parallel to the opposite side surface 78 of the jaws 68 and 70 respectively.

Each of the notches 92 and 94 is defined by an opening in the edge 90 and spaced apart inner walls 96 and 98 which include flat surfaces and extend longitudinally inwardly from the edge 90 through the tip 91 and into a portion of the body 79 of the jaws 68 and 70 respectively. The notches 92 and 94 and, more particularly, the walls 96 and 98 thereof extend in a plane which is generally transverse to the plane of the top and bottom surfaces 72 and 74 of the jaws 68 and 70 and in plane which is generally parallel to the plane of the side surfaces 76 and 78 of the jaws 68 and 70 respectively.

The wall 96 of each of the notches 92 and 94 includes a straight inner portion 100 and a sloped outer portion 102 which is unitary with the portion 100 and diverges outwardly from the straight portion 100 in a direction away from the opposed inner straight wall 98 and terminates into the peripheral edge 90 of the respective jaws 68 and 70. Although FIG. 3 shows the sloped outer portion 102 diverging outwardly at about a 15° angle relative to the portion 100, it is understood that the angle of inclination can be varied as desired without departing from the scope of the present invention.

The notches 92 and 94 and, more particularly, the wall 96 of the notches 92 and 94 in combination with the spaced-apart side surfaces 76 and 78 respectively of the jaws 68 and 70 respectively, define tines 104 and 106 on each of the jaws 68 and 70. The tine 104 includes opposed side surfaces or walls respectively defined by the side surface 76 of the respective jaws and the inner wall 96 of the notch 92 and a tip 105 defined by a portion of the tip 91 of the respective jaws. Tine 106 includes opposed surfaces or walls respectively defined by the side surface 78 of the respective jaws and the inner wall 96 of the notch 94 and a tip 107 defined by a portion of the tip 91 of the respective jaws.

The hand tool 20 of the present invention is adapted for use in the installation of the network of metal ducts which comprise today's forced air type heating and air conditioning systems. The ducts consist of a plurality of separate generally rectangularly or box shaped duct sections which have been joined and secured together along their peripheral and abutting drive edges. Two such duct sections 200 and 202 are shown in FIG. 5.

Figure 5:
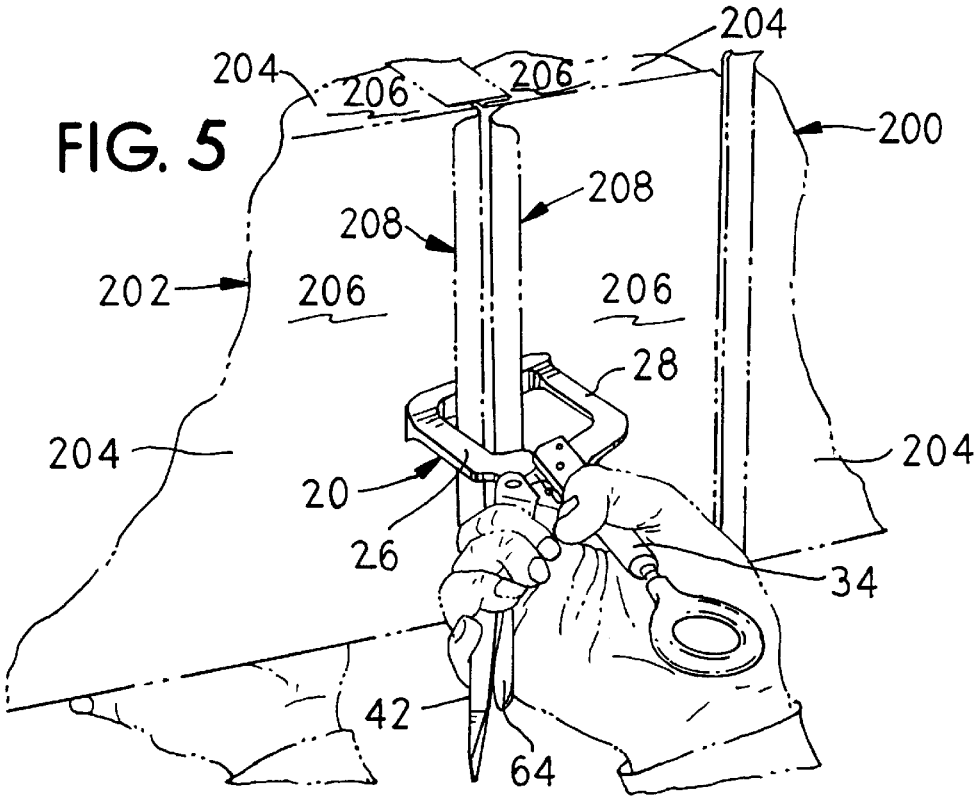
FIG. 5 is a broken perspective view depicting the method for gripping the drive edges of adjacent duct sections where the hand tool of the present invention is used in an orientation generally perpendicular to the duct sections.
Figure 6:
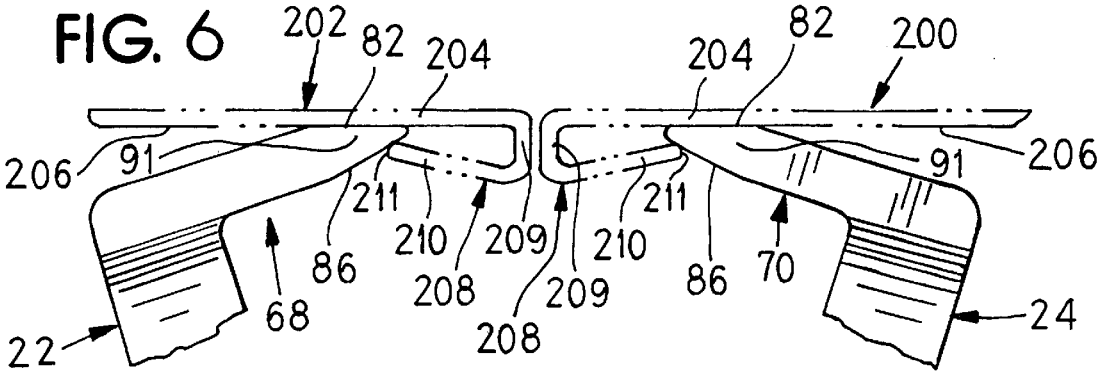
FIG. 6 is an enlarged broken plan view of the engagement between the jaws of the hand tool and the drive edges of the duct sections respectively where the hand tool is positioned and oriented as shown in FIG. 5.

Each of the duct sections 200 and 202 includes four unitary body walls 204 (only two of which are shown in FIG. 5) each including an outer surface 206 and an inwardly bent, generally "U" or hook shaped peripheral end portion defining a drive edge 208 including a bight portion 209 disposed generally transversely to the wall 204 and a unitary longitudinally extending tab 210 including a peripheral longitudinally extending edge 211 (FIG. 6).

Figure 10:
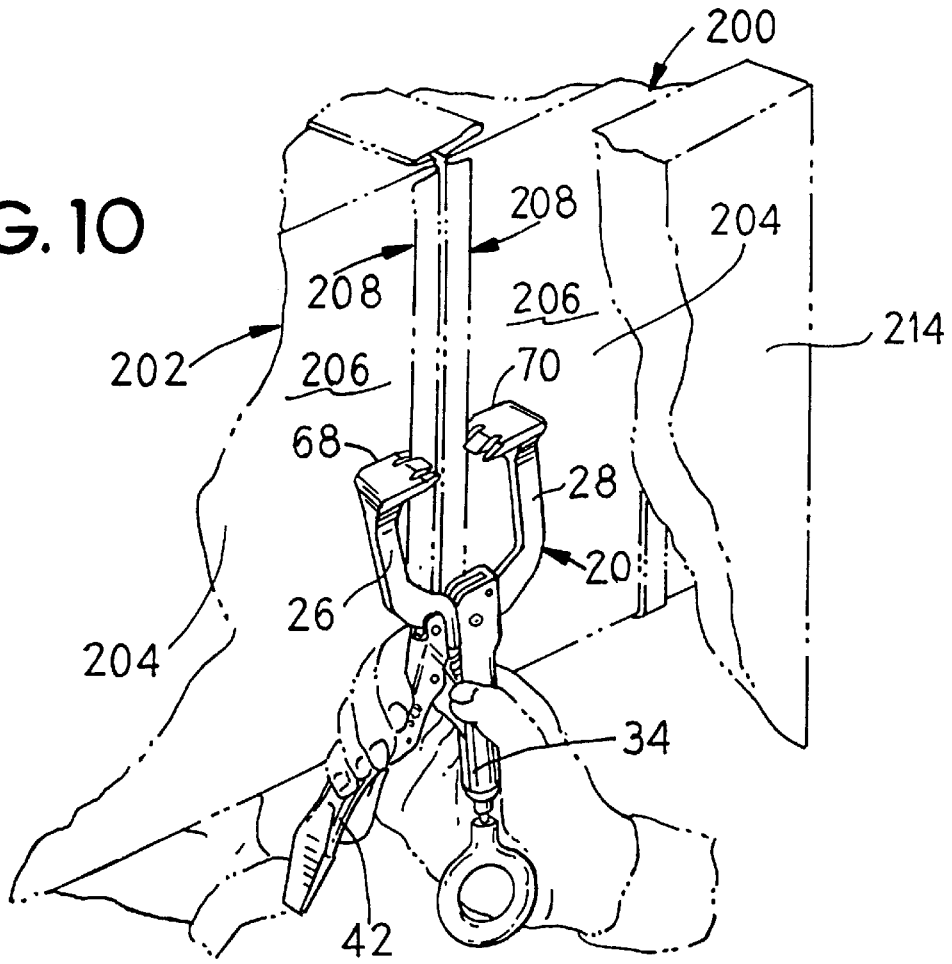
FIG. 10 is a broken perspective view depicting the method for gripping the drive edges of adjacent duct sections where the hand tool of the present invention is used in its alternate orientation generally parallel to the duct sections.

The hand tool 20 of the present invention is particularly adapted to be used in either the orientation of FIG. 5 or the orientation of FIG. 10 for gripping, joining, and clamping together the duct sections 200 and 202 together. It is understood, of course, that the tool 20 is required because considerable pressure is usually necessary to draw the two adjacent ends of the duct sections together and that it is also further usually necessary to hold the duct sections in such adjacent relationship while a drive cleat 213 (FIG. 7) is driven therebetween to secure the two duct sections together.

FIG. 5 depicts the method of using the hand tool 20 in a first orientation where the hand tool 20 is positioned generally transversely or perpendicularly to the walls 204 of the duct sections 200 and 202 respectively.

The installation process usually initially involves prying the tab 210 of the drive edges 200 away from the surface 206 of the walls 204 of the respective duct sections 200 and 202. This is typically accomplished with the use of a screw-driver or the like prying device. However, and as described below, the hand tool 20 and, more particularly, the jaws 68 and 70 thereof dispense with the need for a separate prying device.

As more particularly shown in FIGS. 5 and 6, the jaws 68 and 70 of the hand tool 20 are advantageously structured and adapted to be wedged between the wall 204 and the drive edge 208 of the respective adjacent duct sections 200 and 202 so as to allow the tab 210 of the drive edges 208 to be pried away from the surface 206 of the duct sections 200 and 202 respectively.

The engagement between the hand tool 20 and the duct sections 200 and 202 initially involves the positioning of the hand tool 20 in an orientation generally perpendicular to the wall 204 of duct sections 200 and 202 and subsequently opening and placing the jaws 68 and 70 on opposite sides of the drive edges 208 respectively into contact with the duct sections 200 and 202 respectively such that the sloped top surface 82 of the tip 91 of the jaws 68 and 70 respectively is positioned in abutting and contiguous relationship with the outer surface 200 of the wall 204 duct sections 200 and 202 respectively.

The toggle handle 42 is then squeezed towards the handle 34 to move the arms 26 and 28 and thus the respective jaws 68 and 70 towards the drive edges 208 respectively. The continued squeezing of the toggle handle 42 towards the handle 34 and the resultant lateral inward movement of the jaws 68 and 70 causes the edge 90 of the tip 91 of the respective jaws 68 and 70 to be wedged between the wall 204 and the edge 212 of the tab 210 of the respective drive edges 208. The still continued squeezing of the handles 34 and 42 and the still lateral inward movement of the jaws 68 and 70 relative to the respective drive edges 208 causes the edge 212 of the respective drive edges 208 to contact and slide along the bottom inclined distal end portion or surface 86 of the tip 91 of the respective jaws 68 and 70 so as to cause the respective tabs 210 to be pried away from the surface 206 of the respective duct sections 200 and 202 respectively.

According to the present invention, the sloped top distal end portions 82 of the tip 91 of the respective jaws 68 and 70 advantageously allow for the lateral inward movement of the tip 91 along and in contiguous relationship with the surface 206 of the wall 204 of the duct sections 200 and 202 respectively notwithstanding the fact that the jaws 68 and 70 are brought into engagement with the duct sections 200 and 202 in an orientation where the jaws 68 and 70 are angularly disposed relative to the outer surface 206 of the duct sections 200 and 202. This structure allows for the wedging described above.

If necessary, the wedge 47 at the distal end 44 of the toggle handle 42 can also be used to pry the tab 210 of the drive edges 208 away from the wall 204 of the duct sections 200 and 202 respectively.

Figure 8:
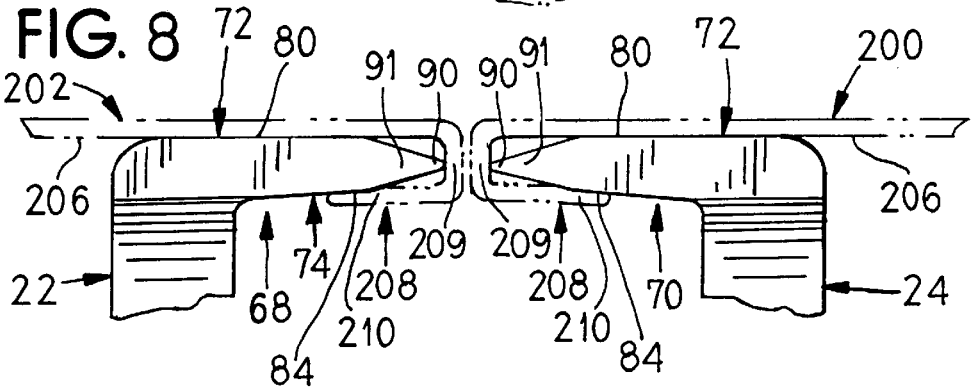
FIG. 8 is an enlarged broken plan view of the engagement between the jaws of the hand tool and the drive edges of the duct sections respectively when the hand tool is clamped to the duct sections as shown in FIG. 7.

The toggle handle 42 is squeezed still further towards the handle 34 to cause the further lateral inward movement of the respective jaws 68 and 70 into the interior of the drive edges 208 and into the gripping position of FIG. 8 where straight portion 80 of the top surface 72 of the respective jaws 68 and 70 is in contiguous and abutting relationship with the outer surface 206 of the wall 204 of the respective duct sections 200 and 202, the edge 90 of the tip 91 of the respective jaws 68 and 70 is positioned in abutting relationship with the inner surface of the bight portion 209 of the respective drive edges 208 and a portion of the straight portion 84 of the bottom surface 74 of the respective jaws 68 and 70 is in contiguous and abutting relationship with a portion of the inner surface of the tab 210 of the respective drive edges 208.

Figure 7:
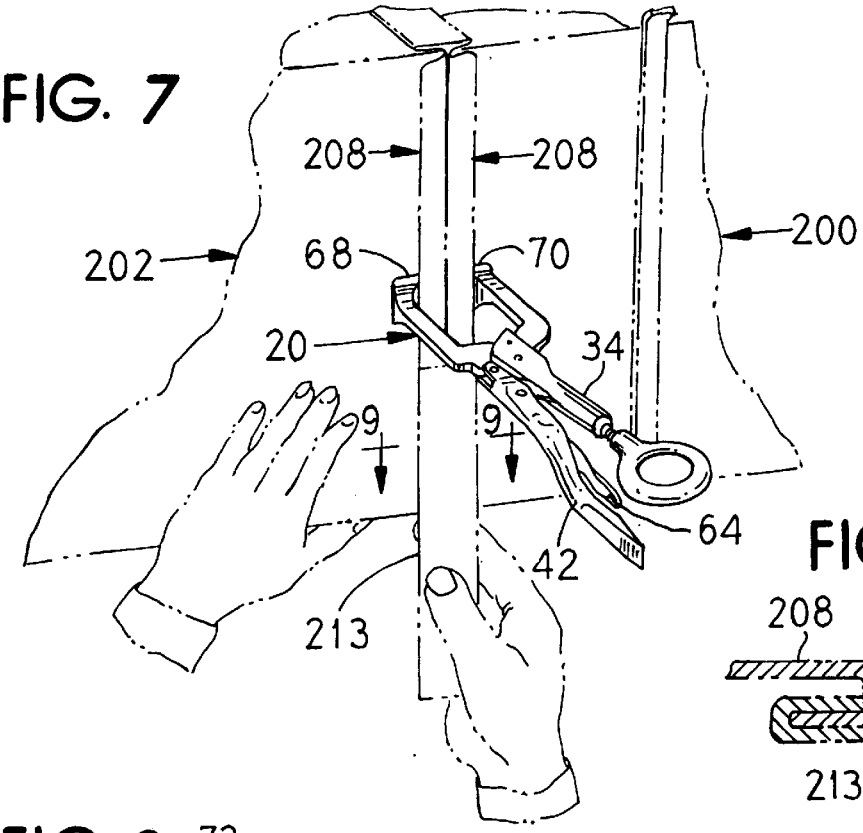
FIG. 7 is a broken perspective view of the hand tool clamped to the adjoining drive edges of abutted duct sections and the method for sliding a drive cleat onto the adjoining duct drive edges to secure the duct sections together.

When the handles 34 and 42 have been gripped together sufficiently to cause the toggle assembly 40 to lock the hand tool 20, as is known in the art of toggle or vice-grip type handles, to the drive edges 208, the duct sections 200 and 202 will have been forced into the adjoining and abutting relationship of FIG. 7. The user can then release his/her hand from the tool 20 as shown in FIG. 7 and the tool 20 will remain in operative engagement with the duct sections 200 and 202 to hold them in their abutting relationship.

Although not shown, it is understood that if the locking of the tool 20 does not bring the duct sections together into sufficient abutting relationship, the ring 56 can be rotated to further bring the jaws 68 and 70 together which, in turn, will further join the duct sections closer together.

Figure 9:
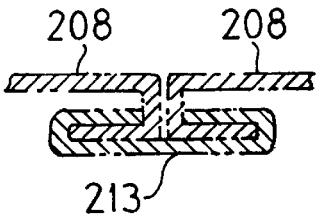
FIG. 9 is a broken plan view taken along the lines 9—9 in FIG. 7 which depicts the securement of a drive cleat to the abutted drive edges of the adjacent duct sections.

The user can then use the hand which has been released from the tool 20 to retrieve and drive a drive cleat 213 onto the drive edges 208. The drive cleat 213 is a standard duct installation member comprising an elongate generally C-shaped bent strip of sheet metal which is driven upwardly from the bottom of the duct sections as shown in FIG. 7 upwardly into engagement with the respective drive edges 208 substantially as shown in FIG. 9 to secure the respective duct sections 200 and 202 together.

The ability to clamp the tool 20 to the duct sections and subsequently release an engaging hand therefrom affords the user the continued use of his/her other hand as shown in FIG. 7 for holding up the bottom of the duct section 202 while the drive cleat 213 is being applied thereto. As a result, there is no need to use either a third person or a separate lifting device to hold the duct section 202 in place during the installation procedure.

Although not shown, it is understood that to assure the continued adjacent and abutting relationship between the respective drive edges 208 as the drive cleat 213 is secured thereto, the tool 20 can easily be successively released and relocked upwardly along the longitude of the drive edges 208 as the drive cleat 213 is driven upwardly along the drive edges 208.

Once the tool 20 is no longer required, the toggle assembly 40 is released as is known in the art by depressing the lever 64 thereby springing the handles away from each other and causing the disengagement of the jaws 68 and 70 from the respective drive edges 208.

Although not shown, it is also understood that the tool 20 can be used to remove a drive cleat 213 from adjacently secured duct sections. This is accomplished by placing the tool 20 with the jaws 68 and 70 thereof in their locked position with either of the side surfaces 76 or 78 thereof in endwise abutting relationship with either the top or bottom end of the drive cleat 213, and striking the opposite one of the side surfaces 76 or 78 of the jaws 68 and 70 with a hammer or the like to slide the drive cleat 213 off the drive edges 208.

The tines 104 and 106 defined by the notches 92 and 94 in each of the jaws 68 and 70 of the hand tool 20 also advantageously allow the tool 20 to be used as shown in FIG. 10 in an orientation generally parallel to the walls 204 of the duct sections 200 and 202. This orientation is necessary where ducts are installed in close proximity to an obstruction 214 such as a wall or the like and there is insufficient clearance between the duct sections and the obstruction to orient the tool 20 perpendicularly to the duct sections 200 and 202 as in FIGS. 5 and 7.

The method of using the tool 20 in such parallel orientation for gripping, joining and clamping together the duct sections 200 and 202 is shown in FIGS. 10–13 and described below in detail.

Figure 11:
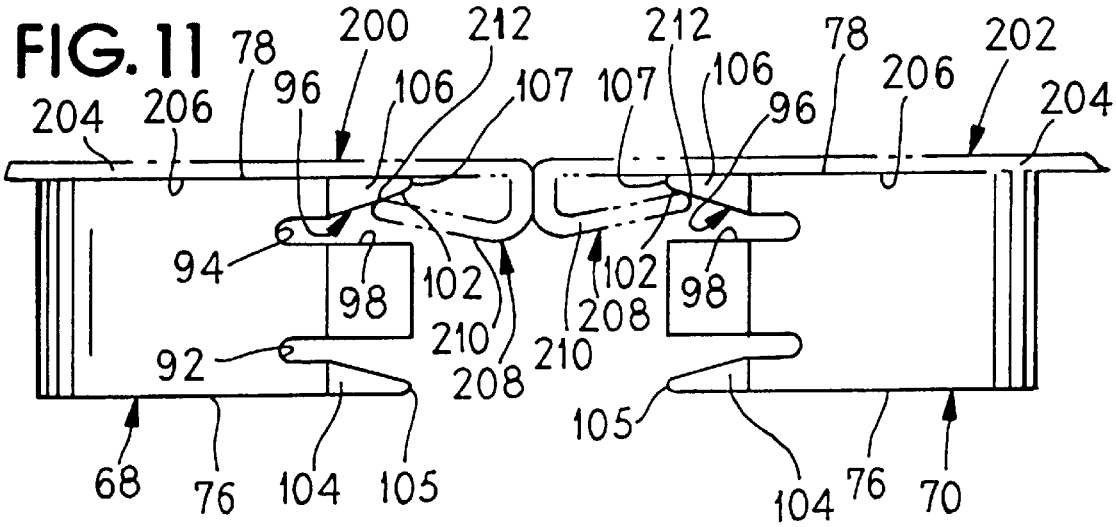
FIG. 11 is an enlarged broken plan view depicting the engagement between the tines on the jaws of the hand tool and the drive edges of the duct sections respectively where the hand tool is positioned and oriented as shown in FIG. 10.

Initially, and as shown in FIGS. 10 and 11, the arms 26 and 28 of the tool 20 are opened and the jaws 68 and 70 are spread apart so as to allow the same to be positioned on opposite sides of the respective drive edges 208 and into contact with the wall 204 of the duct sections 200 and 202 such that the side surface 78 of the respective jaws 68 and 70 is positioned in contiguous and abutting relationship with the outer surface 206 of the wall 204 of the respective duct sections 200 and 202.

The toggle handle 42 is then squeezed towards the tool handle 34 which causes the lateral inward movement of the arms 26 and 28, and thus the jaws 68 and 70, towards each other and into contact with the respective drive edges 208. The continued squeezing of the toggle handle 42 towards the handle 34 and the resultant continued inward lateral movement of the respective jaws 68 and 70 relative to the respective drive edges 208 causes the wedging of the tine 106 on the respective jaws 68 and 70 between the wall 204 of the duct sections and the tab 210 of the drive edge 208 of the respective duct sections 200 and 202.

As shown in FIG. 11, the still continued squeezing of the toggle handle 42 towards the handle 34 and the still resultant inward lateral movement of the jaws 68 and 70 relative to the respective drive edges 208 causes the edge 212 of the tab 210 of the respective drive edges 208 into the notch 94 and, more particularly into sliding contact with the inclined inner wall 96 of the notch 94 so as to cause the tab 210 of the respective drive edges 208 to be pried away from the outer surface 206 of the respective duct sections 200 and 202.

Figure 12:
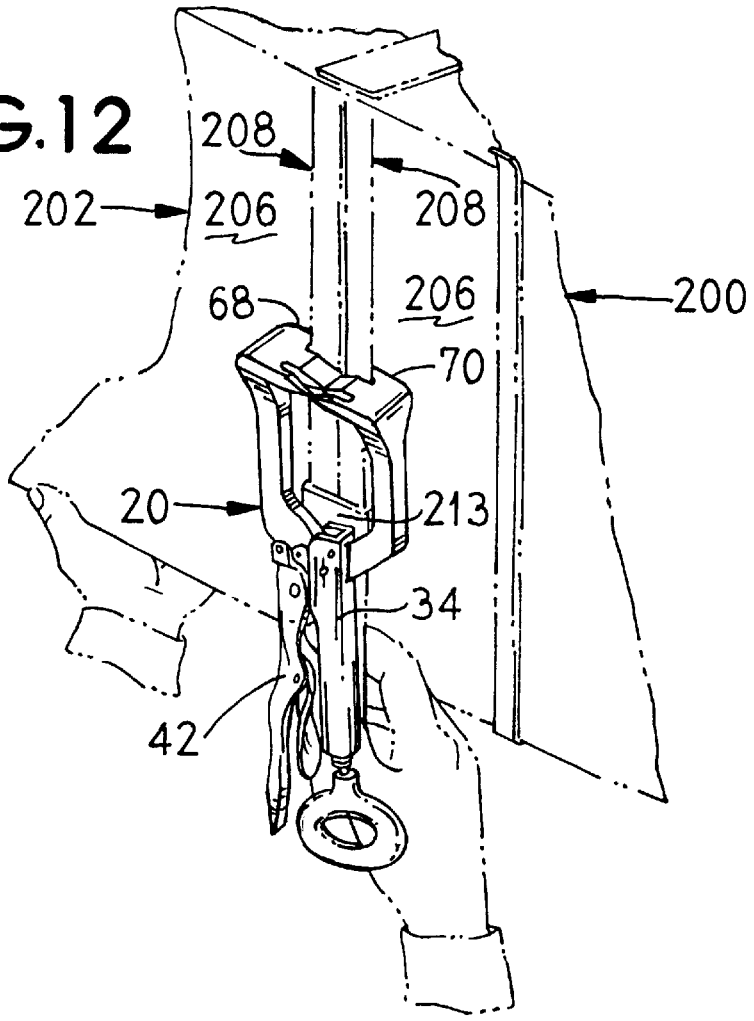
FIG. 12 is a broken perspective view of the hand tool clamped to the adjoining drive edges of adjacent duct sections where the hand tool is oriented generally parallel to the duct sections and the method for sliding a drive cleat onto the adjoining and abutting duct drive edges.
Figure 13:
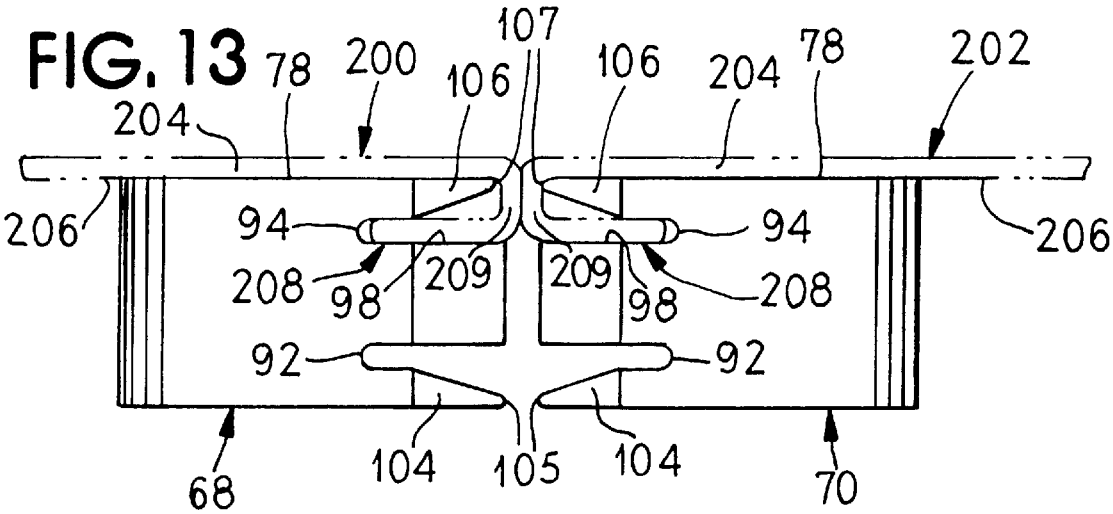
FIG. 13 is an enlarged broken plan view of the engagement between the tines of the jaws of the hand tool and the abutting drive edges of the adjoining duct sections when the hand tool is clamped to the duct sections as shown in FIG. 12.

The toggle handle 42 is squeezed still further towards the handle 34 to cause the further lateral inward movement of the jaws 68 and 70 into the fully gripping relationship of FIGS. 12 and 13 where the tab 210 of the respective drive edges 208 is fully received into the respective notch 94 and the tine 106 is located in the interior of the respective drive edges 208. In this relationship, the side surface 78 of the respective jaws 68 and 70 is in abutting and contiguous relationship with the outer surface 206 of the wall 204 of the duct sections 200 and 202 respectively, the tip 107 of the tine 106 is positioned in abutting relationship with the inner surface of the bight portion 209 of the respective drive edges 208 and the outer surface of the respective drive edges 208 is positioned in abutting and contiguous relationship with the inner wall 98 of the notch 92.

Thereafter, and as explained earlier with respect to FIG. 7, when the handles 34 and 42 have been gripped together sufficiently to lock the toggle assembly 40 and thus the hand tool 20 onto the drive edges 208, the duct sections 200 and 202 will have been forced into the abutting and contiguous relationship of FIGS. 12 and 13. The user can then release his/her hand from the tool 20 as shown in FIG. 12 and the tool 20 will remain in operative engagement with the duct sections 200 and 202 to hold them in abutting and contiguous securement relationship.

As also described earlier with respect to FIG. 7, the user can then again use the hand removed from the tool 20 to retrieve and secure the drive cleat 213 to the drive edges 208 substantially as shown in FIG. 12. As described earlier, and as shown in FIG. 12, the tool clamping feature further affords the user the continued use of his/her other hand for holding up the bottom of the duct section 202 while the drive cleat 213 is being applied thereto.

Although not shown, and as also described earlier with respect to FIG. 7, it is also understood that the tool 20 can be successively released and reclamped upwardly along the longitude of the drive edges 208 as the drive cleat 213 is driven successively upwardly onto the drive edges 208 to assure the continued abutting and contiguous relationship of the drive edges 208 as the cleat 213 is secured thereto from bottom to top.

It is also understood that the drawings depict the use of the tool 90 by a right handed user and further that the notches 92 opposite the notches 94 allow the tool 20 to be turned 180° and used by a left handed user substantially in the same manner as depicted in FIGS. 10–13 except, of course, that the tine 104 on the jaws 68 and 70 respectively would be wedged between the wall 204 and the drive edges 208 of the duct sections 200 and 202 respectively.

Although not shown, it is further understood that the tool 20 is likewise useable in its parallel orientation relative to the duct sections 200 and 202 for removing the drive cleat 213 from the duct sections 200 and 202. This is accomplished by placing the tool 20 with the jaws 68 and 70 thereof in their locked position with the top surface 72 thereof in endwise abutting relationship against either of the ends of the drive cleat 213. The bottom of the ring 56 can then be struck with a hammer or the like to slide the drive cleat 213 off the drive edges 208.

Figure 14:
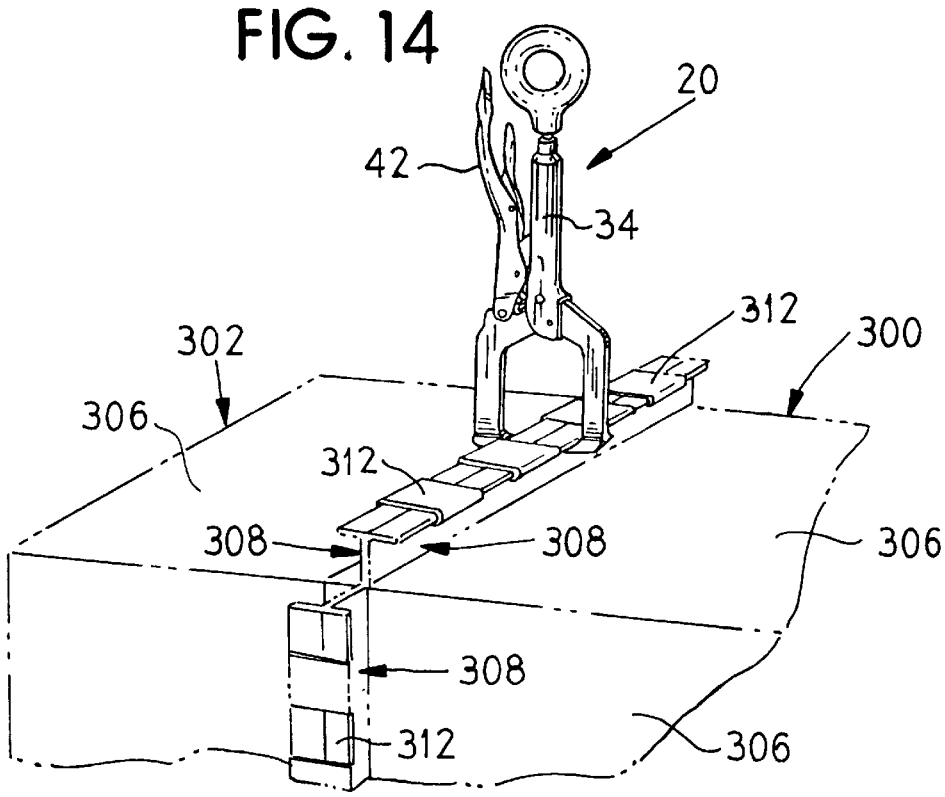
FIG. 14 is a broken perspective view depicting the hand tool of the present invention clamped to the adjoining drive edges of an alternate duct sections embodiment and clips for securing the duct sections together.
Figure 15:
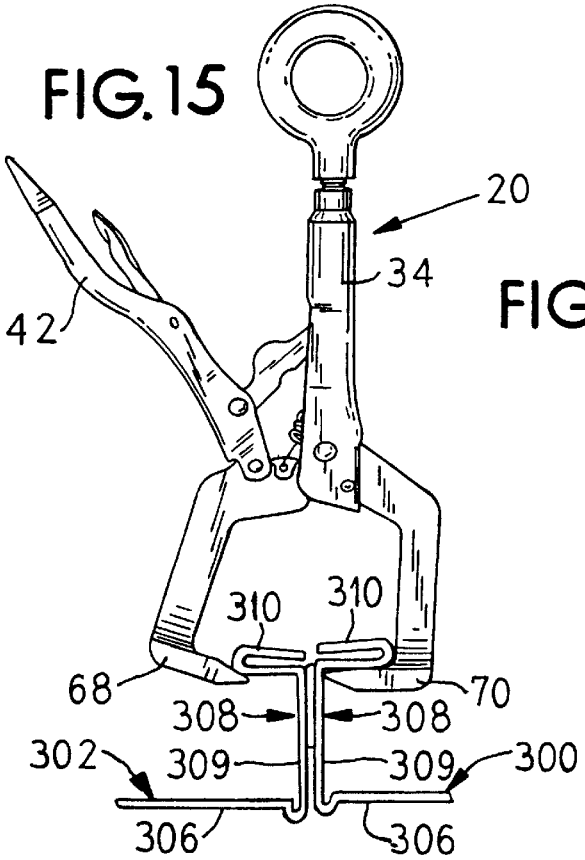
FIG. 15 is a broken elevational view depicting the engagement between the jaws of the hand tool and the respective adjoining drive edges of the alternate duct sections embodiment.
Figure 16:
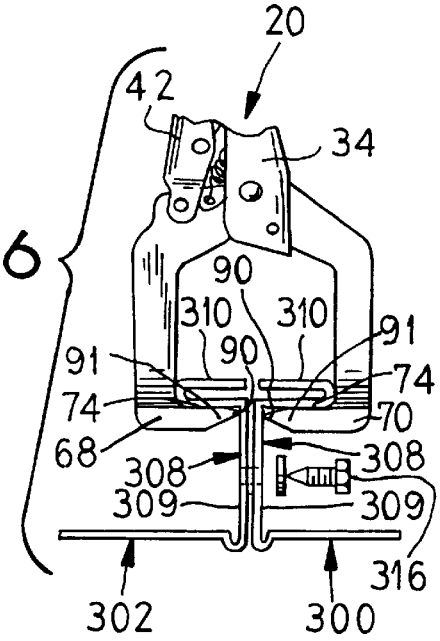
FIG. 16 is a broken elevational view of FIG. 14 depicting the hand tool in its clamped position surrounding the abutting drive edges of the adjoining duct sections respectively and a screw being applied thereto to secure the duct sections together.

Yet another contemplated use of the tool 20 of the present invention is in connection with the installation and securement of commercial grade ducting such as the TDC type duct sections 300 and 302 depicted in FIGS. 14–16. Such duct sections differ in structure from the duct structure shown in FIGS. 5–13 in that the duct sections 300 and 302 are significantly larger in size and include drive edges 308 including an elongated bight portion 309 extending perpendicularly outwardly unitarily from the wall 306 of the respective duct sections 300 and 302 and a C-shaped inwardly turned distal tab 310 disposed parallel to and, in spaced-apart relationship from, the wall 306 of the respective duct sections 300 and 302.

As shown in FIG. 14, the generally hook or C-shaped configuration of the arms 26 and 28 of the tool 20 advantageously allows the respective jaws 68 and 70 to be easily wrapped around the respective drive edges 308, and more particularly, the tabs 310 thereof into a position where the inner surface 74 of the respective jaws 68 and 70 engages the lower surface of the tab 310 of the respective drive edges 308. The tool 20 is thereafter appropriately maneuvered to allow the alignment of the duct sections 300 and 302 in an orientation where the tabs 310 of the respective drive edges 308 are co-planarly aligned with each other as shown in FIG. 15.

As described earlier, the toggle handle 42 is subsequently squeezed in the direction of the handle 34 so as to place the jaws 68 and 70 in the gripping and locking position of FIG. 16 where the peripheral edge 90 the tip 91 of the respective jaws 68 and 70 is positioned in abutting relationship with the outer surface of the bight portion 309 of the respective drive edges 308 and the inner surface 74 of the respective jaws 68 and 70 is disposed in abutting and contiguous relationship with the lower surface of the tab 310 of the respective drive edges 308.

Once the tool 20 has been locked to the drive edges 308, the user can release his/her hand from the tool 20 and the tool will remain in operative engagement with the duct sections 300 and 302 in the same manner as described earlier with respect to FIG. 7. Thereafter, the user can use both hands to retrieve and secure the duct sections 300 and 302 together by means of C-shaped clips 312 (FIG. 14) adapted to be wrapped and squeezed around the abutted tabs 310 of the respective drive edges 308. The clips 312 can be substituted with a plurality of screws 316 or the like which are fastened through the abutted bight portions 309 of the drive edges 308 (FIG. 16).

The foregoing is illustrative of the principles of the present invention of a hand tool including jaws which allow the tool to be used in a first orientation where the tool is positioned generally perpendicular to the duct sections for gripping, joining and clamping together adjacent duct sections and further includes tines in the jaws which allow the tool to be used in a second orientation where the tool is positioned generally parallel to the duct sections.

Further, since numerous modifications and changes will readily occur to those skilled in the art, it is not desired to limit the invention to the exact construction and operation shown as described. Accordingly, all suitable modifications and equivalents may be resorted to while still falling within the scope of the invention.

What is claimed is:

1. A hand tool for use in gripping and joining together adjacent duct sections each including an outer surface and a peripheral hook shaped end portion defining a drive edge including a tab, said hand tool comprising:

first and second handles;

first and second arms operably associated at one end thereof with said first and second handles respectively;

first and second jaws operably associated with, and extending inwardly from the opposite end of, said first and second arms respectively, said jaws being movable and positionable towards and away from each other in response to the movement of one or both of said first and second handles, said first and second arms having a length which allows the placement of said first and second jaws in an open relationship wherein the distance between said first and second jaws is greater than the combined width of the tabs of the drive edges of the adjacent duct sections for gripping the drive edge of said respective duct sections between the outer surface and the tab of the respective drive edge thereof; and each of said first and second jaws including a top surface having a generally straight back portion extending generally transversely outwardly from said first and second handles respectively and a sloped distal end portion converging outwardly from said back portion, said top surface of said respective first and second jaws contiguously engaging the outer surface of said respective duct sections to facilitate the wedging of said respective jaws between the outer surface and the tab of the drive edge of the respective duct sections.

2. The hand tool of claim 1 wherein each of said first and second jaws also includes an outwardly converging bottom surface adapted to engage the tab of the drive edge of said respective duct sections and wedge said respective first and second jaws between the outer surface and the tab of the drive edge of the respective duct sections.

3. The hand tool of claim 1 wherein each of said first and second jaws includes a notch therein adapted to receive the tab of the respective drive edges thereof when said first and second jaws grip the drive edges of the respective duct sections.

4. The hand tool of claim 1 wherein each of said first and second jaws includes a tine adapted to be wedged between the tab of the drive edge and the outer surface of the respective duct sections.

5. A hand tool for gripping and joining together adjacent duct sections each including an outer surface and a drive edge including a tab, said hand tool comprising:

first and second handles;

first and second jaws operatively associated with said first and second handles respectively, said jaws being movable and positionable towards each other into a closed relationship wherein said first and second jaws are generally co-planarly aligned; and each of said first and second jaws including a tip having a notch therein having a depth approximately equal to the width of the tab of the drive edge of the respective duct sections whereby said hand tool is operable in a first orientation wherein said hand tool is positioned generally perpendicularly to the duct sections and said tip is adapted to be wedged between the outer surface and the tab of the drive edge of the respective duct sections when said first and second jaws are brought into gripping engagement with the respective duct sections, said hand tool being further operable in a second orientation wherein said hand tool is positioned generally parallel to the duct sections and the tab of the drive edge of the respective duct sections respectively is received in said notch respectively when said first and second jaws are brought into engagement with the respective drive edges of the direct sections.

6. The hand tool of claim 5 wherein each of said first and second jaws includes opposed side peripheral surfaces and said notch is positioned adjacent one of said opposed side peripheral surfaces so as to define a tine on said first and second jaws respectively including an inclined inner surface adapted to engage the tab of the drive edge of the respective duct sections when said first and second jaws are brought into engagement with the respective drive edges of the respective duct sections.

7. A hand tool for gripping, joining and clamping together adjacent duct sections each including an outer surface and a drive edge including a bight portion and a tab, said hand tool comprising:

first and second arms;

first and second jaws extending generally transversely inwardly from said first and second arms and having a length approximately equal to or greater than the width of the tab of the drive edge of the respective duct sections for gripping the respective drive edge of the adjacent duct sections;

a handle assembly operatively associated with said first and second arms for bringing together said first and second jaws together into a closed relationship wherein said first and second jaws are generally co-planarly aligned and joining the duct sections gripped thereby;

a lock assembly associated with said first and second handles for releasably locking said first and second jaws and said hand tool to the adjacent duct sections;

each of said first and second jaws including side surfaces and top and bottom surfaces defining a tip;

each of said first and second jaws further including a tine on said tip having a length approximately equal to or greater than the width of the tab of the respective drive edge of the respective duct sections; and whereby said hand tool is operable in a first orientation where said hand tool is positioned generally perpendicularly to the duct sections and said tip on said first and second jaws respectively is adapted to be wedged between the outer surface and the drive edge of the respective duct sections into contact with the respective bight portion thereof when said first and second jaws are brought into engagement with the drive edge of the respective duct sections, said hand tool being operable in a second orientation where said hand tool is positioned generally parallel to the duct sections and said tine on said first and second jaws respectively is adapted to be wedged between the outer surface and the drive edge of said respective duct sections into contact with the respective bight portion thereof when said first and second jaws are brought into engagement with the drive edge of the respective duct sections.

8. The hand tool of claim 7 wherein said tine on each of said first and second jaws includes an inclined and inwardly diverging inner surface adapted to engage the drive edge of the respective duct sections when said first and second jaws are brought into engagement with the drive edge of the respective duct sections.

9. The hand tool of claim 7 further including another tine on said tip of each of said first and second jaws and spaced-apart from said tine.

* * * * *